US006554643B1

(12) United States Patent
Whiting

(10) Patent No.: US 6,554,643 B1
(45) Date of Patent: Apr. 29, 2003

(54) CONNECTOR PRESS FIT MOUNTING PROJECTION

(75) Inventor: David E. Whiting, Etters, PA (US)

(73) Assignee: FCI Technology, Inc., Reno, NV (US)

( * ) Notice: Subject to any disclaimer, the term of this patent is extended or adjusted under 35 U.S.C. 154(b) by 0 days.

(21) Appl. No.: 09/322,273

(22) Filed: May 28, 1999

(51) Int. Cl.[7] ..... H01R 13/73
(52) U.S. Cl. ..... 439/571; 439/567
(58) Field of Search ..... 439/571, 572, 439/573, 562, 567, 247, 65, 82

(56) References Cited

U.S. PATENT DOCUMENTS

| | | | | | |
|---|---|---|---|---|---|
| 3,678,797 | A | * | 7/1972 | Seckerson | 411/509 |
| 3,815,077 | A | * | 6/1974 | Anhalt et al. | 439/70 |
| 4,664,458 | A | * | 5/1987 | Worth | 439/82 |
| 4,691,971 | A | | 9/1987 | Hahn | 439/78 |
| 4,734,043 | A | * | 3/1988 | Emert et al. | 439/65 |
| 5,120,257 | A | | 6/1992 | Hahn | 439/567 |
| 5,302,134 | A | * | 4/1994 | Thomas et al. | 439/247 |
| 5,334,047 | A | | 8/1994 | Lutsky | 439/544 |
| 5,336,110 | A | | 8/1994 | Mosquera | 439/554 |
| 5,366,389 | A | * | 11/1994 | Kreutter | 439/571 |
| 5,542,860 | A | | 8/1996 | Bandura et al. | 439/567 |
| 5,790,660 | A | * | 8/1998 | Vlaeminck | 439/676 X |
| 5,928,005 | A | * | 7/1999 | Li et al. | 438/82 |
| 6,254,421 | B1 | * | 7/2001 | Denovich et al. | 439/409 |

* cited by examiner

*Primary Examiner*—Lynn D. Feild
*Assistant Examiner*—Son V. Nguyen
(74) *Attorney, Agent, or Firm*—Woodcock Washburn LLP

(57) ABSTRACT

An electrical connector apparatus and method adapted for locating and mechanically supporting a connector to a substrate, such as a Printed Circuit Board (PCB), in a manner that allows for a nominal insertion force, while at the same time a sufficient retention force to hold the connector on the PCB. The connector has a plurality of mounting projections extending downward from a bottom mounting surface of the connector housing that are adapted for connection to a corresponding plurality of holes formed in the PCB. The projections have one or more ribs extending outward along the longitudinal length of the projection. The ribs are tapered such that a circle around at least a portion of the upper portion of the one or more ribs has a transverse dimension greater than the transverse dimension of the hole in the PCB, and the ribs tapers down toward the distal end of the projection such that a second circle around at least a portion of the lower portion of the one or more ribs has a transverse dimension not greater than the transverse dimension of the hole in the PCB. This feature provides for a nominal insertion force to hold the connector on the PCB over a wide variance in the tolerances between the transverse dimension of the mounting projection and the transverse dimension of the hole in the PCB, and also variances in the tolerances between the distances between individual holes in the PCB, in relation to the distance between the mounting projections. In addition, the ribs deform, such that at least a portion of the rib is displaced to provide a sufficient retention force to hold the connector on the PCB.

14 Claims, 6 Drawing Sheets

CONNECTOR PRESS FIT MOUNTING PROJECTION

FIELD OF THE INVENTION

This invention relates generally to electrical connectors that can be mounted on a substrate, such as a printed circuit board (PCB), and more particularly the present invention relates to an apparatus and method of mechanically attaching the connector to the PCB.

BACKGROUND

In the manufacturing of electronic equipment, it is frequently necessary to mount an electrical connector on a substrate, a panel, or a printed circuit board (PCB). Various mechanical mounting methods are known, such as screws, bolts, rivets, posts, etc., for holding the housing of the electrical connector on the substrate or PCB until it is soldered.

Mounting posts attached of the connector housing are particularly well suited for surface mount type connectors. These mounting posts typically project downwardly from the housing of the connector and support the connector on the PCB. The mounting posts are inserted into holes formed in the PCB and provide a means of accurately locating the terminals of the connector over electrically conductive traces on the PCB and also provide a means of holding the connector in place on the PCB prior to the connector being more permanently affixed thereon. For example, it may be desirable to support the connector on a PCB prior to it being affixed thereon by a more permanent method, such as by soldering of the terminals of the connector to electrical traces on the PCB.

A problem with conventional type methods of supporting a connector on a substrate or PCB is maintaining the proper insertion and retention forces necessary to efficiently locate and hold the connector on the PCB. It is preferred to have a relatively low or nominal insertion force over a wide range of tolerances between the connector and the PCB, while at the same time having a sufficient retention force between the connector and the PCB. Several factors adversely affect the insertion force and the retention force, including manufacturing tolerances of the mounting posts and the holes on the PCB, and also the manufacturing tolerances between individual holes in the PCB.

The dimensional tolerances between the mounting posts of the connector and the holes in the PCB are important in providing an acceptable insertion force and a sufficient retention force of the connector to the substrate. Maintaining the proper dimensional tolerances during the manufacturing of the mounting posts of the connector and the holes in the PCB is often difficult and expensive. Excessive variations in the transverse dimension of the mounting posts of the connector and the transverse dimension of the holes in the PCB may lead to problems with locating and holding the connector on the PCB. In the case where the tolerances require a minimum mounting post dimension and a maximum hole dimension, a low insertion force will generally be required, but a low retention force will result and the connector may not be properly held on the PCB. Conversely, where the tolerances require a maximum mounting post dimension and a minimum hole dimension, an excessive insertion force may be required, resulting in difficulty in inserting the mounting posts into the holes, damage to the mounting post, or in the extreme case, the inability to connect the connector to the PCB.

Another dimensional tolerance that may lead to problems in the ability to properly locate and hold the connector on the PCB is the board hole spacing tolerance (e.g., the variance in the distance between the individual holes in the PCB, as it relates to the distance between the mounting posts of the connector). The distance between holes in the PCB, as it relates to the distance between the mounting posts, is also important in providing an acceptable insertion and a sufficient retention force of the connector to the PCB. Excessive variations in the tolerances of the distances between holes in the PCB, as it relates to the distance between the mounting posts may lead to problems in ensuring the proper location and connection between the mounting posts of the connector and the holes of the PCB.

Accordingly, a need still exists for providing an apparatus and method for supporting various connectors on a substrate or printed circuit board that overcomes the above problems.

SUMMARY

The present invention overcomes the limitations noted above with respect to the prior art devices for locating and holding a connector on a substrate, such as a printed circuit board (PCB), by providing a connector housing having at least two mounting projections extending downwardly from a bottom mounting surface of the housing to locate and hold the connector on the PCB. The mounting projections have one or more ribs disposed thereon forming a projection/rib combination. The ribs extend outwardly from the body of the projection and running substantially along the longitudinal length of the projection. The mounting projection/rib combination is adapted to form an interference fit with a corresponding hole formed in the PCB. Where more than one rib is disposed on the projection, the ribs are preferably disposed at substantially equal distances around the circumference of the projections. In addition, the orientation of the ribs is preferably offset as between individual projections.

In addition, the ribs have a tapered design, such that the ribs extend outward more at the end of the projection closest to the housing and the distance that the rib extends outward from the projection decreases as the rib runs away from the housing toward a distal end of the projection. The taper design of the ribs forms an inclined surface on the outer longitudinal edge of the ribs. This provides a connector to substrate interface having a nominal or average insertion force over a wide range of tolerances and also a sufficient retention force to hold the connector on the PCB.

The combination of each mounting projection and ribs is further formed such that the transverse dimension of the projection body is less than the transverse dimension of the corresponding hole in the substrate. The combination of each projection and ribs is formed such that a transverse dimension of at least an upper portion of a cross section of the combination proximate the top or first end of the projection proximate the connector housing is greater than the transverse dimension of the hole formed in the PCB, and a transverse dimension of at least a lower portion of a cross section of the projection/rib combination proximate the distal or second end is less than the transverse dimension of the hole in the PCB. This tapered design forms an inclined surface that acts to compensate for tolerance variations between the transverse dimension of each projection of the connector and the transverse dimension of the corresponding hole in the PCB.

The one or more ribs are formed of a material that deforms and is displaced from the ribs as the projection/rib combination is inserted into the hole formed in the PCB. The ribs contact the side walls of the holes, such that the projections form an interference fit with the holes of the PCB resulting in a sufficient retention force to hold the connector on the PCB.

According to one aspect of the present invention, the connector is formed having two projections extending downward from opposite ends of the housing. Each projection is formed having two ribs disposed along the longitudinal length of the projection and the ribs are located on each projection 180 degrees apart. The ribs have a tapered design to compensate for tolerance variations between the transverse dimension of each projection of the connector and the transverse dimension of a corresponding hole in the PCB. In addition, the ribs on each projection are oriented 90 degrees out of phase from the ribs on the other projection. The ribs are turned 90 degrees between each projection to compensate for variations in the substrate hole spacing tolerances.

The connector of the present invention is designed for mechanically supporting an electrical connector to a substrate, such as a PCB, in such a manner that allows for an average or nominal insertion force for different sized mounting projections and holes in the substrate. The projection, by having tapered ribs disposed on the circumference of the projection that extend outward therefrom and run substantially along the longitudinal length of the projections, has the desired effect of providing for a nominal insertion force for locating the connector on the PCB, while at the same time providing for a sufficient retention force to hold the connector on the PCB. The projections having tapered ribs that form an inclined surface provide a connector having a nominal insertion force and sufficient retention force over a wide range of tolerances in the dimensions of the transverse dimension of the projection to the transverse dimension of the hole, and also the tolerances between the distances between individual holes in the substrate, in relation to the distance between the mounting projections on the connector.

BRIEF DESCRIPTION OF THE DRAWINGS

These and other features, aspects, and advantages of the present embodiment of the invention will become better understood with regards to the following description, appended claims, and accompanying drawings where:

DETAILED DESCRIPTION OF THE PREFERRED EMBODIMENTS

Figure 8:
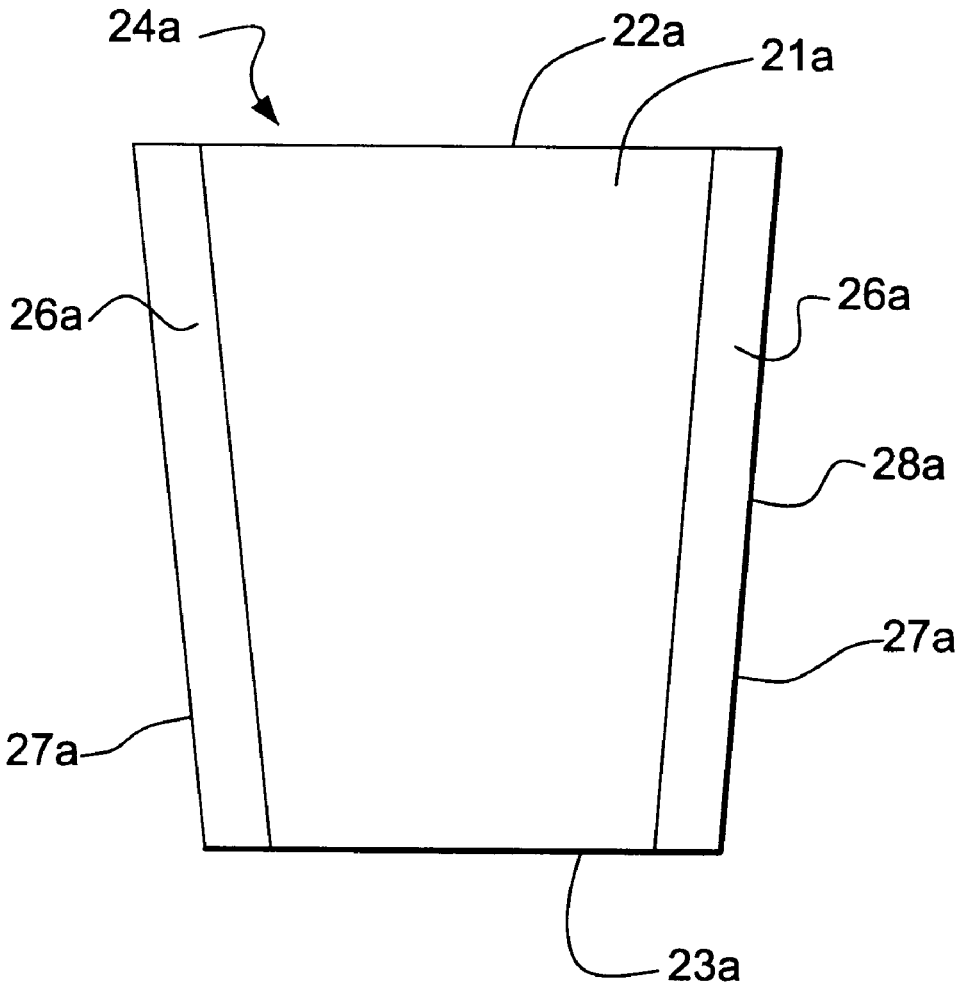
FIG. 8 is a cross-sectional view of a second alternative embodiment of the projection/rib combination of the present invention.

Throughout the following detailed description similar reference numbers refer to similar elements in all the figures of the drawings. With reference to FIGS. 1 through 6, shown is an exemplary embodiment of an electrical connector 10 having a projection/rib combination 24 adapted for mechanical connection to a substrate, a panel, or a Printed Circuit Board (PCB) 30 in accordance with the present invention. With reference to FIGS. 7A–7E, shown are several alternative shapes that the projection body may take. With reference to FIG. 8, shown is a second alternative embodiment of a connector having a projection/rib combination 24 of the present invention.

Figure 1:
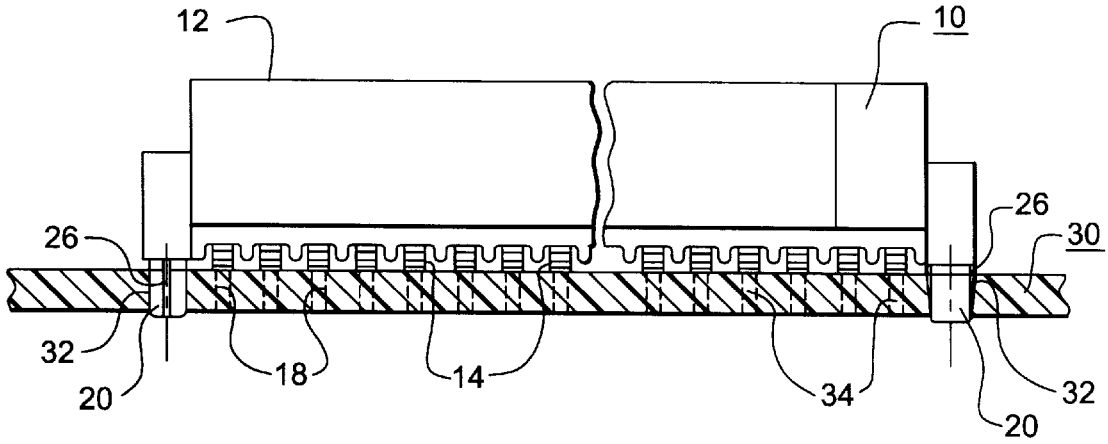
FIG. 1 is a front view of an exemplary embodiment of an electrical connector having press fit projections of the present invention for locating and holding the connector on a PCB.

As shown in FIG. 1, electrical connector 10 is adapted to be mechanically and electrically connected to PCB 30. PCB 30 is provided with a plurality of holes 32 for receiving and supporting electrical connector 10. The PCB 30 is made from conventional materials, preferably R-4 material. PCB 30 also comprises a plurality of electrically conductive contact pads or traces 34 adapted for establishing an electrical connection between PCB 30 and connector 10.

Figure 2:
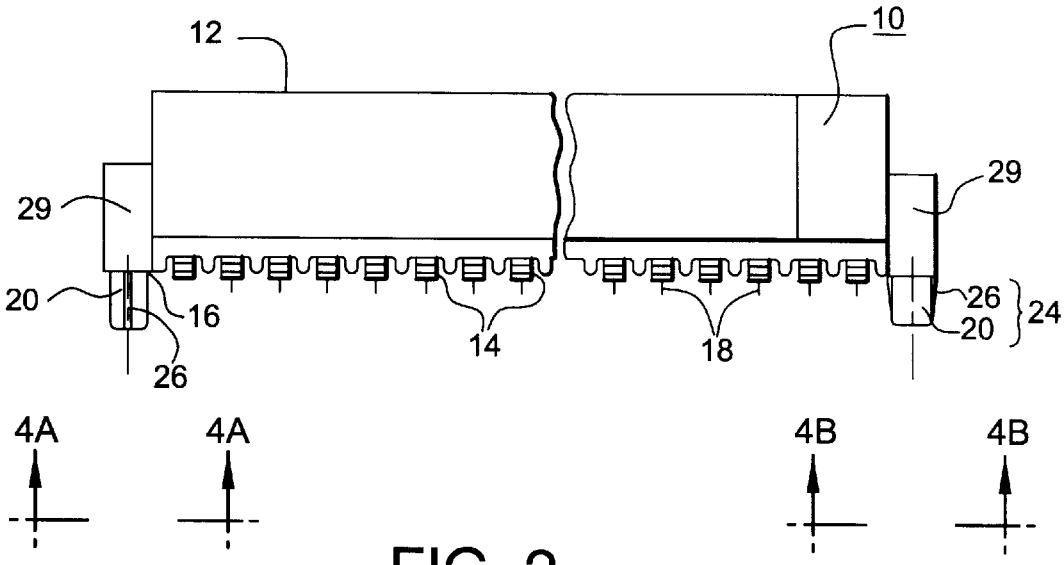
FIG. 2 is a front view of the electrical connector having the press fit projections of FIG. 1.

FIGS. 1 through 5 show a first exemplary electrical connector 10 of the present invention comprising a housing 12, at least one contact terminal 14 disposed in the housing 12 for establishing an electrical connection between connector 10 and PCB 30, and a bottom mounting surface 16 for supporting connector 10 on PCB 30. As shown in FIGS. 1 and 2, connector housing 12 supports an arrangement of electrical contacts 14 therein. Each of the individual contacts 14 has a contact tail 18 that extends beyond housing 12 and functions to make contact with the traces 34 on PCB 30 for establishing one or more electrical connections between PCB 30 and connector module 10.

The housing 12, projections 20 and ribs 26 will ordinarily be a single molded part which is comprised of a plastic material which is softer than the material of the substrate or the PCB 30 so that the ribs 26 will be deformed during insertion of the projection 20. Preferably this plastic material will also be sufficiently resilient to regain at least some of its original shape after insertion so as to better secure the connector 10 on the substrate or PCB 30 after such insertion. Suitable plastic materials would include polyester liquid crystal polymers such as ZENITE available from DuPont (6130L), XYDAL available from BP/Amoco, VECTRA available from Ticona/Hoerst, and THERMX LG available from Eastman Chemical, amorphous polyesters such as THERMX CG available from Eastman Chemical, aromatic nylons such as ZYTEL available from DuPont, and AMODEL available from BP/Amoco; aliphatic nylons such as STANYL available from DSM; and syndiotatic polystyrenes such as QUESTRA available from Dow.

As shown in FIG. 2, connector 10 also includes at least two mounting projections 20 extending downward from mounting flanges 29 formed at each end of connector housing 12. Where mounting flanges 29 are employed, the projections 20 preferably extend downwardly from a bottom surface 16 of the mounting flanges 29. Alternatively, the mounting projections 20 may extend downward from an underside or bottom surface 16 of housing 12. The mounting projections 20 are adapted for insertion into corresponding holes 32 formed in PCB 30 for mechanically locating and holding connector 10 on PCB 30. The number of projections 20 will generally increase as the size of the connector 10 increases. Preferably two mounting projections 20 are used, one at each end of the housing 12.

Figure 3:
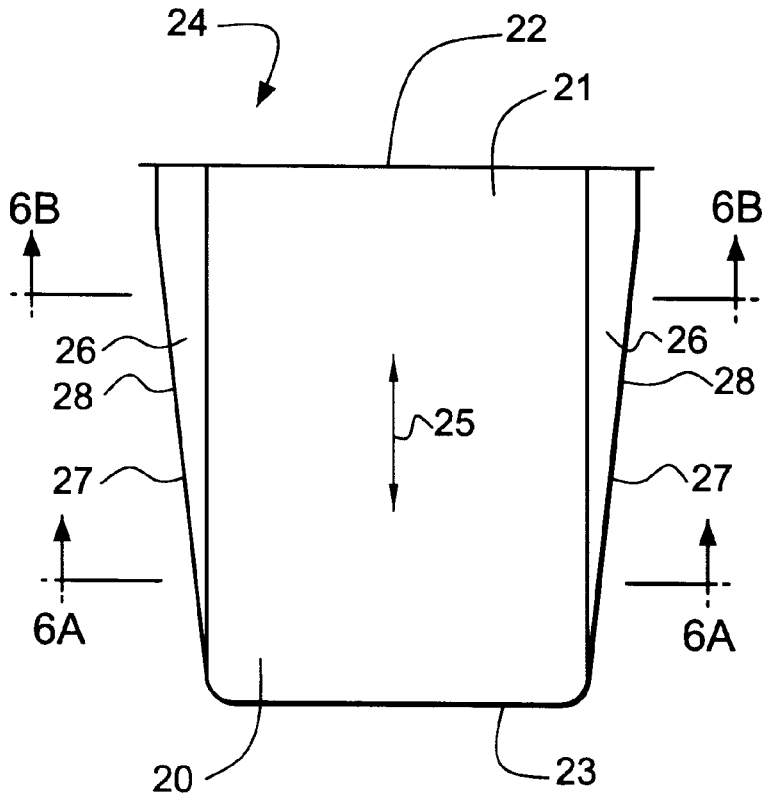
FIG. 3 is a detailed side view of a press fit projection/rib combination of the electrical connector of FIG. 1.

Referring to FIGS. 2 and 3, each mounting projection 20 includes a body 21 having a longitudinal axis 25, a first end 22 attached to a bottom mounting surface 16 of the connector 10, and a second end 23 defined by the distal, or free, end of the projection 20. Projection 20 may be formed separate from and then coupled to the connector 10, or preferably, the projections 20 are formed integral with connector 10. Body 21 is sized so as to have a transverse dimension d1 that is less than a transverse dimension d2 of the corresponding hole 32 in PCB 30.

Projections 20 are shown in FIGS. 1 through 6 having a circular shape column-like body having a constant cross-sectional diameter. However, it should be noted that the invention contemplates that the projections 20 may take any suitable shape, including a square, a rectangle, a diamond, a triangle, an oval, a star, etc. FIG. 7 shows a bottom view of several alternative shapes that body 21 may take. It should be noted that the shapes shown in FIGS. 7A–7E show for illustrative purposes only and are not intended to limit the scope of the invention. The holes 32 in PCB 5 are formed to correspond to the shape of the projections 20. In the preferred embodiment shown, the holes 32 are formed having a circular shape and have a constant diameter d2 over the depth of the hole 32.

Figure 9:
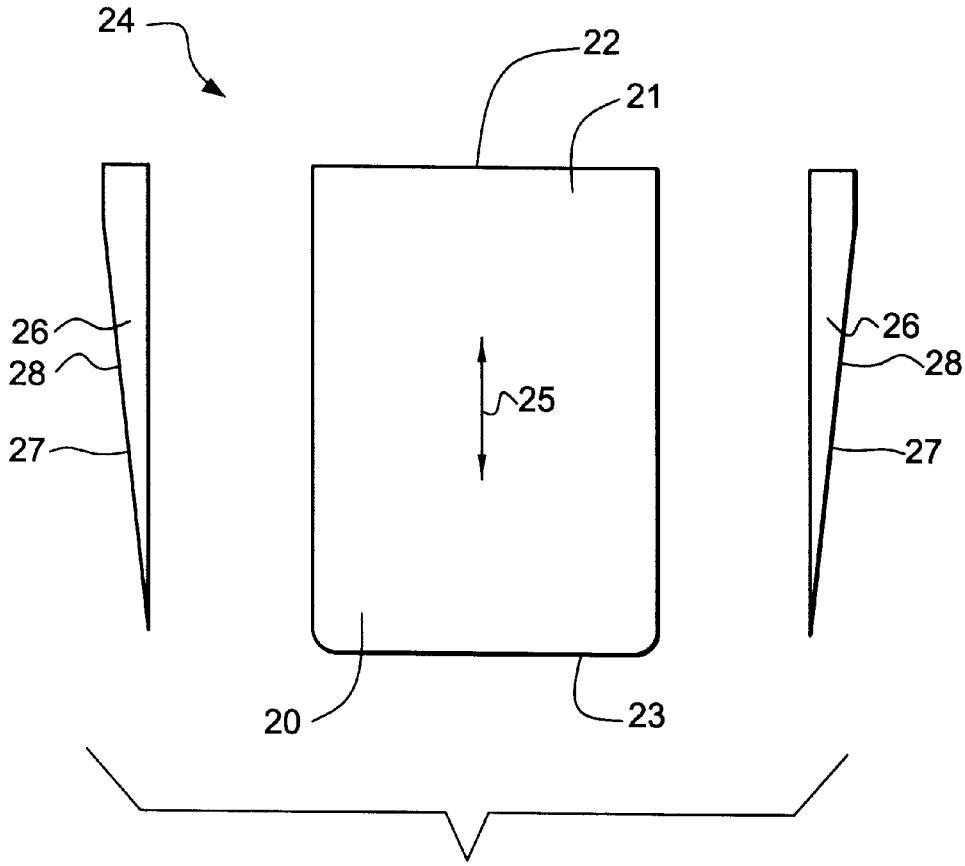
FIG. 9 is detailed side view of another exemplary press fit projection/rib combination in accordance with the present invention.

As shown in FIGS. 2 and 3, one or more ribs 26 are disposed on body 21 of each projection 20, thus forming a projection/rib combination 24. Ribs 26 are adapted to form an interference fit with holes 32 in PCB 30. The ribs 26 extend outward from body 21. Ribs 26 are preferably formed in a substantially straight line and have a length substantially equal to the longitudinal length of projection 20 (e.g., substantially from first end 22 to second end 23 of body 21). Alternatively, the ribs 26 may be formed at an angle or having a curved or zig zagging shape. The ribs 26 may be formed separate form and then coupled to body 21, as shown in FIG. 9 or preferably, the ribs 26 are formed integral with body 21.

Ribs 26 are disposed on each projection 20 at approximately equal distances (e.g., equal spacing) around the circumference or outer perimeter of each projection body 21. Accordingly, the spacing between each rib 26 depends on the number of ribs 26. In a preferred embodiment where two ribs 26 are disposed on each projection 20, the ribs 26 are disposed on body 21 approximately 180 degrees apart. Alternatively, if three ribs 26 are used, then the ribs 26 are spaced approximately 120 degrees apart, if four ribs 26 are used, then the ribs 26 are spaced approximately 90 degrees apart, etc.

Figure 4A:
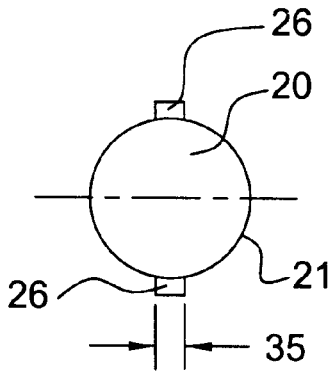
FIG. 4A is a bottom view of the press fit projection/rib combination of the electrical connector of FIG. 2 as viewed along line 4A—4A.
Figure 4B:
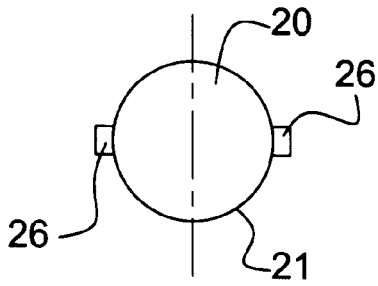
FIG. 4B is a bottom view of the press fit projection/rib combination of the electrical connector of FIG. 2 as viewed along line 4B—4B.

In addition, the rib or ribs 26 on each projection 20 are oriented out of phase, or offset, with the rib or ribs 26 of the other projection or projections 20. For example, as shown in FIGS. 2, 4A, and 4B, for a connector 10 having two ribs 26 disposed on each of two projections 20, the ribs 26 of each mounting projection 20 are oriented 90 degrees out of phase from the ribs 26 on the other projection 26. The ribs 26 are offset 90 degrees between each projection 20 to compensate for variations in the substrate hole 32 spacing tolerances.

Ribs 26 are preferably formed having a tapered design such that the ribs 26 taper up from second end 23 to first end 22 on each projection 20. As shown in FIG. 3, each rib 26 extends outward a greater distance at the top or first end 22 than it extends outward at the bottom or second end 23 of body 21 (e.g., the distance that the rib 26 extends outward from the projection body 21 increases as the rib 26 runs along the longitudinal axis of body 21 from the distal end or second end 23 toward first end 22 proximate housing 12).

This tapered design of the outer edge 28 of rib 26 forms an inclined surface 27 along an outer edge 28 of each rib 26. Inclined surface 27 provides a connector 10 to substrate 30 interface having a nominal or average insertion force over a wide range of tolerances and also a sufficient retention force to hold the connector 10 on the PCB 30. Inclined surface 27 helps in locating the projection 20 having tapered ribs 26 in hole 32. The tapered design of ribs 26 results in a lower insertion force by reducing the amount of rib 26 material that must be displaced proximal the second end 23 in order to form the interference fit with hole 32. The tapered design also results in a higher retention force by providing more rib 26 material proximal the first end 22 thereby forming the interference fit.

The width of the rib 26 is dependent on the specific application. Preferably, the width of rib 26 increases for larger application. For example, for an application having a PCB hole 32 of about 0.047 inch, the mounting projection body 21 transverse dimension is about 0.040 inch and a rib having a width of about 0.0065 inch is preferred. The width of rib 26 is adapted to allow for a relatively low insertion force while still ensuring a sufficient retention force to hold the connector 10 on PCB 30.

Figure 5:
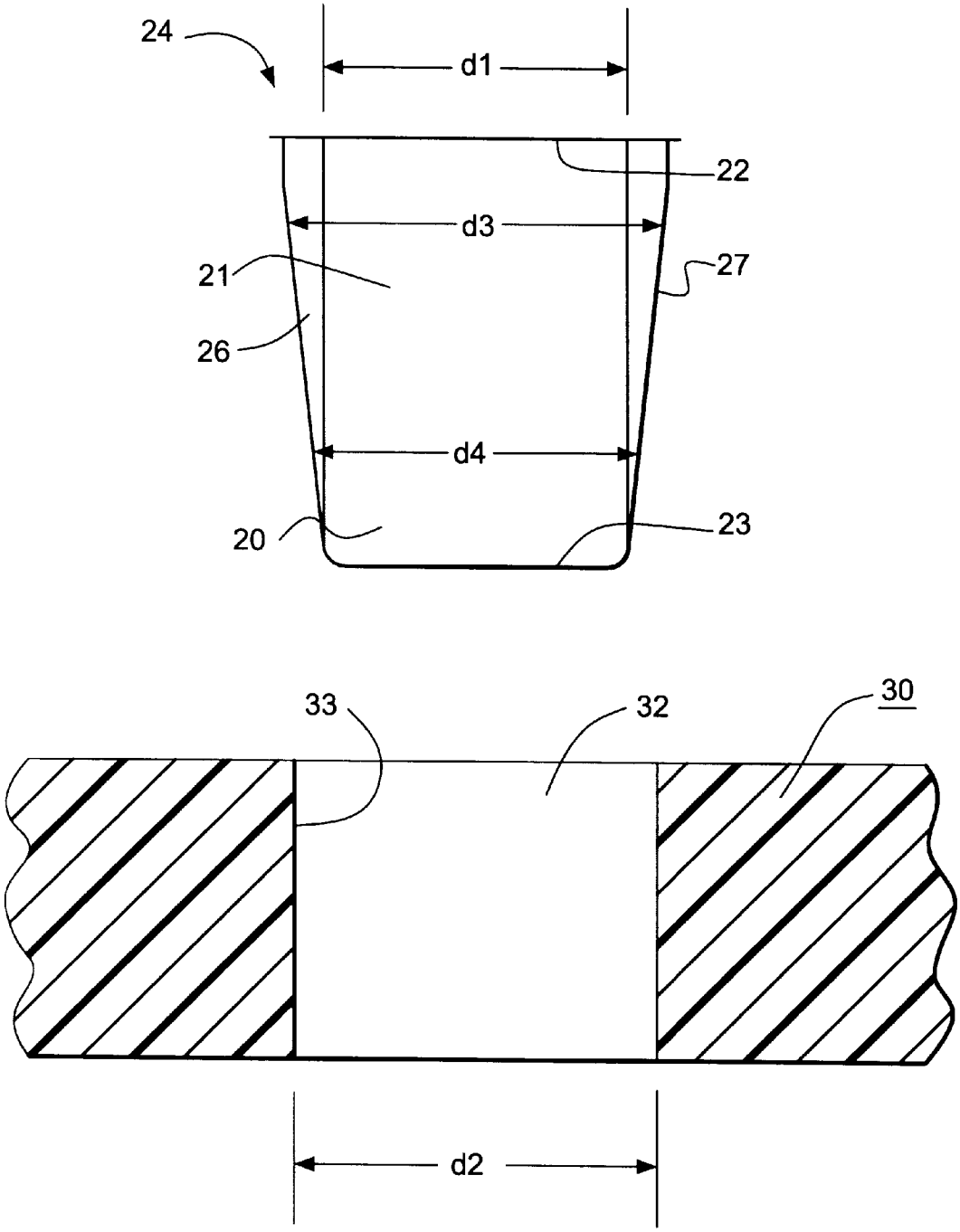
FIG. 5 is a detailed view of one of a press fit projections of FIG. 1 prior to insertion into a hole of a PCB.

As shown in FIG. 5, the combination 24 of mounting projection 20 having one or more ribs 26 is further formed such that the transverse dimension d1 of projection 20 is less than the transverse dimension d2 of the corresponding hole 32 in substrate 30. The projection/rib combination 24 is formed such that a transverse dimension d3 of at least an upper portion of a cross section of the projection/rib combination 24 proximate the top or first end 22 is greater than the transverse dimension d2 of hole 32 formed in PCB 30, and a transverse dimension d4 of at least a lower portion of a cross section of the projection/rib combination 24 proximate the distal or second end 23 is less than the transverse dimension d2 of hole 32 in PCB 30. Preferably, each of the above described transverse dimensions has a tolerance associated with it to account for variances in the manufacturing process of the connector 2 and the PCB 5.

Figure 6A:
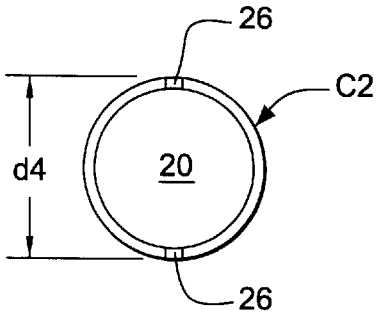
FIG. 6A is a cross-sectional view of the press fit projection/rib combination of the electrical connector of FIG. 3 taken along line 6A—6A.
Figure 6B:
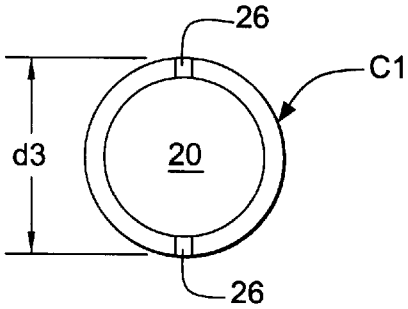
FIG. 6B is a cross-sectional view of the press fit projection/rib combination of the electrical connector of FIG. 3 taken along line 6B—6B.
Figure 7A:
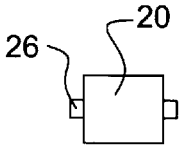
FIGS. 7A–7E shows a bottom view of several alternative projection shapes of the press fit projection/rib combination of the electrical connector in accordance with the present invention.
Figure 7B:
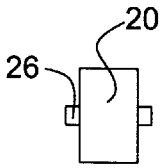
Figure 7C:
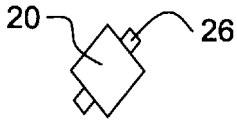
Figure 7D:
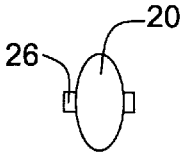
Figure 7E:
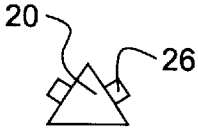

The transverse dimension d1 of projection 20 is the maximum transverse dimension of the projection 20. For example, for the circular projection shown in FIGS. 3, 4, and 5, the transverse dimension d1 is the diameter of the projection body 21. The transverse dimension d2 is the maximum transverse dimension of the hole 32 in PCB 5. For example, for the circular hole 32 shown in FIG. 5, the transverse dimension d2 is the diameter of the hole 32. As shown in FIGS. 6A and 6B, the transverse dimension d3 is the maximum transverse dimension of a circle C1 formed about the outer peripheral of the projection/rib combination 24 proximal at least an upper portion of the projection/rib combination 24. For example, for the circular projection 20 having two ribs disposed about 180 degrees apart as shown in FIGS. 3, 4, and 5, the transverse dimension d3 is the diameter of a circle C1 about the upper portion of the combination 24 (e.g., the diameter of the projection body 21 plus the maximum height of the ribs 26 at the first end 22). The transverse dimension d4 is the maximum transverse dimension of a circle C2 formed about the outer peripheral of the projection/rib combination 24 proximal at least a lower portion of the projection/rib combination 24. For example, for the circular projection 20 having two ribs disposed about 180 degrees apart as shown in FIGS. 3, 4, and 5, the transverse dimension d4 is the diameter of a circle C2 about a lower portion of the combination 24 (e.g., the diameter of the projection body 21 plus the minimum height of the ribs 26 at the second end 23).

The tapered design forming inclined surfaces 27 compensates for tolerance variations between transverse dimension d1 of each projection body 21 of connector 10 and transverse dimension d2 of corresponding hole 32 in PCB 30. This design ensures that an interference fit will exist between the projection/rib combination 24 and the PCB 30. This provides for a connector 10 that has a nominal insertion force and a sufficient retention force over a wide range of tolerances.

The projection/rib combination 24 is adapted to form an interference fit with holes 32 on PCB 30. The ribs 26 are constructed to deform as the connector 10 is attached to the PCB 30. Accordingly, the ribs 26 are constructed such that the rib 26 material is displaced as projections 20 are inserted into holes 32 in PCB 30. The ribs 26 are formed from a material that is pliable and softer than the material of the PCB 30. As the projection/rib combination 24 is inserted into the holes 32 of the PCB 30, the outer edge 28 of the ribs 26 contact the side wall 33 of each hole 32, and the ribs 26 begin to deform (e.g., the material of the rib 26 is displaced).

Preferably, the ribs permanently deform once they are inserted into a hole 32 of a PCB 30. Permanently deforming means that the ribs 26 do not return to their original shape if the connector 10 is removed from the PCB 30. As the ribs 26 deform, they act to forms an interference fit with a corresponding hole 32 in PCB 30. The rib material may either be shaved away, displaced, or deformed from projection 20. The tapered design of ribs 26 reduces the amount of the rib 26 material that must be deformed or displaced during the insertion of the mounting projection 20 into hole 32. This provides for a relatively low insertion force over a wide range of tolerances while still providing for a sufficient retention force to hold connector 10 on PCB 30.

The number of ribs 26 is preferably predetermined based on the specific application and the desired insertion and retention forces. For example, it is preferred that a sufficient number of ribs 26 are employed to ensure an adequate retention force, while at the same time, not having too many ribs 26 such that an excessive amount of rib material must be displaced thereby unnecessarily increasing the insertion force necessary to mount the connector 10. In addition, the number of ribs 26 used in a particular application may depend on the distance that the ribs 26 extend from the projection body 21, as well as the width 35 of each rib 26. This invention allows for in a nominal insertion force while still providing the retention necessary to hold the connection 10 on the PCB 30.

The connector 10 of the present invention is designed for mechanically supporting a connector 10 to a substrate 30, such as a PCB, in such a manner that allows for an average or nominal insertion force for different sized mounting projections 20 and holes 32 in the substrate 30. The projections 20, by having tapered ribs 26 disposed about the circumference of body 21, have the desired effect of providing a nominal insertion force for locating connector 10 on PCB 30, while at the same time providing a sufficient retention force to hold connector 10 on PCB 30. The projections 20 having tapered ribs 26 provides a connector 10 having both a nominal insertion force and a sufficient retention force over a wide range of tolerances in the dimensions of the transverse dimension d1 of the projection 20 to the transverse dimension d2 of the hole 32, and also the tolerances between the distances between individual holes 32 in the substrate 30, in relation to the distance between the mounting projections 20 on the connector 10.

EXAMPLE

In a first example, the projection 20 has a circular shaped column-like body 21 having a transverse dimension d1 defined by the cross-sectional diameter of body 21 of 0.040 inch with a tolerance of plus or minus 0.001 inch, the corresponding circular shaped hole 32 in the PCB 5 had a transverse dimension d2 defined by the cross-sectional diameter of hole 32 of 0.047 inch with a tolerance of plus or minus 0.002 inch, and the transverse dimension d3 of at least an upper portion of the projection/rib combination 24 proximal the first end 22 was defined by a cross-sectional diameter of a circle C1 about the peripheral of the combination 24 of 0.052 inch with a tolerance of plus or minus 0.001 inch. Accordingly, $d1_{min}$ was 0.039 inch and $d1_{max}$ was 0.041 inch, while $d2_{min}$ was 0.045 inch and $d2_{max}$ was 0.049 inch, and $d3_{min}$ was 0.051 inch and $d3_{max}$ was 0.053 inch and $d3_{ave}$ was 0.047 inch. The difference between the maximum diameter d3 of the projection/rib combination 24 and the minimum diameter d2 of the hole 32 is defined as $d3_{max}-d2_{min}=0.008$ inch. The following additional relationships would exist:

$$d3_{max}/d2_{min}=0.053\text{ inch}/0.045\text{ inch}=1.1777\text{ inch}$$

$$d3_{min}/d2_{max}=0.051\text{ inch}/0.049\text{ inch}=1.0408\text{ inch}$$

$$d3_{ave}/d2_{ave}=0.052\text{ inch}/0.047\text{ inch}=1.1063\text{ inch}$$

From the above, the preferred relationship of d3 to d2 is in the range of from about 2% to about 20% greater than d2, and a more preferred range is about 4% to about 18%. Also, note that $d3_{min}$ is always greater than $d2_{max}$, and $d1_{max}$ is always less than $d2_{min}$.

In this first example, the range of the ratio between the width wr of the rib and the diameter d1 of the projection can be determined based on the data and assuming a tolerance of about 0.001 inch as follows:

$$wr_{max}/d1_{min}=0.0075\text{ in}/0.039\text{ in}=0.1923\text{ inch}$$

$$wr_{min}/d1_{max}=0.0055\text{ in}/0.041\text{ in}=0.1341\text{ inch}$$

$$wr_{ave}/d1_{ave}=0.0065\text{ in}/0.040\text{ in}=0.1625\text{ inch}$$

From the above, a preferred range of rib width to projection diameter ratios is about 5% to about 25%, and a more preferred range is about 13% to about 19%.

A second working example of a connector having press fit mounting projections of the present invention was manufactured according to the following description. The working example included a 0.050 inch CC Vertical Header connector 10 having a projection 20 extending a distance of about 0.044 inch from a bottom surface 16 at each end of the connector housing 12. The connector housing was DUPONT 6130L liquid crystal polymer. The housing 12 had an overall length of about 1.3 inch, a height of about 0.221 inch, and a width of about 0.225 inch. The connector had a weight of about 1.02 grams. The projection 20 had a circular cross-section having a diameter d1 of about 0.040 inch. The ribs 26 extended outward from the body 21 of projection 20 a distance (height) of about 0.006 inch, had a length of about 0.044 inch and had a width of about 0.0065 inch. The projection/rib combination 24 had a transverse dimension d3 about at least an upper portion of the combination 24 of about 0.052 inch and a transverse dimension d4 about at least a lower portion of the combination 24 of about 0.040 inch.

The transverse dimensions d3 and d4 are further defined by the diameter of a circle C1 and C2 about the outer peripheral of the projection/rib combination 24. C1 is a circle about at least an upper portion of the projection/rib combination 24 proximal the first end 22 and C2 is a circle about at least a bottom portion of the projection/rib combination 24 proximal the second end 23. Accordingly, the variance between the diameter d3 of at least an upper portion of the projection/rib combination 24 and the diameter d4 of at least a lower potion of the projection/rib combination 24 is about 0.012 inch. This variance between the transverse dimension of the upper portion and the lower portion of the projection rib combination 24 is further defined by the inclined surface having a slope of about 8 degrees.

The following test was performed on the connector 10 described in the second example above. The purpose of the test was to measure the average insertion force and the average retention force for three sizes of holes 32 in a PCB 30. The PCB was made from R-4 material and the three sizes of holes 32 tested. The three hole 32 sizes tested were a diameter d2 of about 0.045, 0.047, and 0.049 inch. The connector 20 that was tested was the RIBCAGE 91855-C2 ®. Thirty samples were tested for each hole 32 size. The test was conducted using an X-Y setup to hold the connector 10 and to bring the connector 10 down over the PCB 30 until the projections 20 were located over the holes 32. The projections 20 were inserted into the holes 32 to a depth of about 0.052 inch and then withdrawn from the hole 32. It should be noted that there were no solder pads 34 (or traces) on the PCB 30. During each sample, the peak forces for the insertion and removal of the projection/rib combination 24 was recorded and then an average insertion and retention force was calculated.

For the 0.045 inch hole 32 in the PCB 30, the average insertion force was 1086 grams, and the average withdrawal force was 312 grams. For the 0.047 inch hole 32 in the PCB 30, the average insertion force was 744 grams, and the average withdrawal force was 221 grams. For the 0.049 inch hole 32 in the PCB 30, the average insertion force was 352 grams, and the average withdrawal force was 97 grams.

From the foregoing example and test, it will be appreciated that it may be advantageous to construct an electrical connector 2 having one or more mounting projections 20 extending therefrom, wherein each projection 20 has one or more ribs 26 formed thereon for forming a mechanical connection between the connector 2 and a PCB 30. The test data shows that forming the projection/rib combination 24 having a tapered design provides for an electrical connector 2 having a relatively low insertion force and, at the same time, a sufficient retention force to support and hold the connector 2 on the PCB 30.

In a second alternative embodiment of the invention shown in FIG. 8, each projection 20*a* may be formed having a non-uniform shape and thickness. For example, a circle shaped column-like body 21*a* having a tapered shape, tapering from the second end 23*a* to the first end 22*a*. One or ribs 26*a* having a uniform height and thickness is then disposed on the body 21*a* forming a projection/rib combination 24*a*. The taper of body 21*a* forms an inclined surface 27*a* along an outer edge 28*a* of the one or more ribs 26*a*. As shown in FIG. 8, two ribs 26*a* are disposed on body 21*a* about 180 degrees apart along the length of body 21*a* from the top end 22*a* to the bottom end 23*a*.

Again, the bottom end 23*a* of the projection body 21*a* has a smaller cross-sectional diameter than the diameter of hole 32 and the top end 22*a* has a diameter greater than the diameter of the PCB hole 32. As the projection 20*a* is inserted into a PCB hole 32, the inclined surface 27*a* forming the outer edge 28*a* of each rib 26*a* slides along the inner wall of the hole 32 in PCB 30. The ribs 26*a* are adapted to deform forming a mechanical connection between the connector 2 and the PCB 30. The ribs 26*a* are constructed to provide a relatively low insertion force while at the same time a sufficient retention force to hold the connector 10 on the PCB 30. This provides the same beneficial features as described above.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for connection to a substrate, such as a printed circuit board (PCB), having a plurality of spaced apart mounting holes of a predetermined transverse dimension formed therein, said connector comprising:

a housing;

at least one contact terminal disposed in said connector housing for establishing an electrical connection to said PCB;

at least two mounting projections extending from said housing, each of said mounting projections comprising a body of a constant diameter and having a longitudinal axis, a first end attached to said housing, and a second end formed at a distal end of each of said mounting projections; and at least one rib extending outwardly from each of said at least two mounting projections thereby forming a projection/rib combination for mechanical engagement with said mounting holes in said PCB to support and hold said connector to said PCB;

wherein each of said at least one rib includes a length comprising a straight section and a tapered section, said tapered section being a majority of the rib length such that the amount of rib material deformed or displaced during connector insertion is minimized; and wherein a cross-section of each of the projection/rib combinations is related to the predetermined transverse dimension of each of said mounting holes in the PCB such that said connector has a nominal insertion force into said mounting holes and a sufficient retention force to support and hold said connector to said PCB.

2. The connector of claim 1, wherein each of said projection/rib combinations is further formed such that said variable cross-section decreases from said first end toward said second end, wherein a cross-section of at least an upper portion of each of said projection/rib combinations defines a transverse dimension greater than said transverse dimension of each of said mounting holes in said PCB, and wherein a cross-section of at least a lower portion of each of said projection/rib combinations is less than said transverse dimension of each of said mounting holes.

3. The connector of claim 2, wherein the rib tapered section has a slope of about 8 degrees.

4. The connector of claim 2, wherein said transverse dimension of said at least an upper portion of each of said projection/rib combinations is from about 2% to about 20% greater than said transverse dimension of each of said mounting holes in said PCB.

5. The connector of claim 4, wherein said transverse dimension of said at least an upper portion of each of said projection/rib combinations is from about 4% to about 18% greater than said transverse dimension of each of said mounting holes in said PCB.

6. The connector of claim 1, wherein each of said at least two mounting projections comprises one of a circle shape, a square shape, a rectangle shape, a diamond shape, an oval shape, and a triangle shape.

7. The connector of claim 1, wherein each of said at least two mounting projections comprise two or more ribs, and wherein said two or more ribs are formed at substantially equal distances from one another about a circumference of each of said at least two mounting projections.

8. The connector of claim 7, wherein each of said at least two mounting projections has two ribs formed 180 degrees apart.

9. The connector of claim 1, wherein said at least one rib on each of said at least two mounting projections is oriented out of phase with said at least one rib of another of said at least two mounting projections.

10. The connector of claim 1, wherein each of said at least one rib has a width, and wherein a ratio of rib width to mounting projection transverse dimension ranges from about 5% to about 25%.

11. The connector of claim 10, wherein said ratio ranges from about 13% to about 19%.

12. The connector of claim 1, wherein said ribs are comprised of a first material and said PCB is comprised of a second material, and said first material is softer than said second material.

13. A portion of a connection between a connector and a printed circuit board (PCB) having a mounting hole of a predetermined transverse dimension formed therein, comprising:

a connectors housing;

at least one contact terminal disposed in said connector housing for establishing an electrical connection to said PCB;

a mounting projection extending from said connector housing, said mounting projection comprising a body having a longitudinal axis, a first end attached to said housing, and a second end formed at a distal end of each of said mounting projections; and at least one rib extending outwardly from said mounting projection thereby forming a projection/rib combination for mechanical engagement with said mounting hole in said PCB to support and hold said connector to said PCB, wherein each of said at least one rib includes a length comprising a straight section and a tapered section, said tapered section being a majority of the rib length such that the amount of rib material deformed or displaced during connector insertion is minimized; and wherein a transverse dimension of an upper portion of said projection/rib combination is about 2% to about 20% greater than said transverse dimension of said hole in said PCB.

14. The connection of claim 13, wherein said transverse dimension of an upper portion of said projection/rib combination is about 4% to about 18% greater than said transverse dimension of said hole in said PCB.

* * * * *

UNITED STATES PATENT AND TRADEMARK OFFICE

CERTIFICATE OF CORRECTION

PATENT NO. : 6,554,643 B1
DATED : April 29, 2003
INVENTOR(S) : David E. Whiting

It is certified that error appears in the above-identified patent and that said Letters Patent is hereby corrected as shown below:

Title page,
Insert Item -- [73] Assignee: FCI Americas Technology, Inc. --

Signed and Sealed this

Ninth Day of September, 2003

JAMES E. ROGAN
*Director of the United States Patent and Trademark Office*